US011056095B2

(12) United States Patent
Christoph

(10) Patent No.: US 11,056,095 B2
(45) **Date of Patent: *Jul. 6, 2021**

(54) ACTIVE NOISE REDUCTION EARPHONES

(71) Applicant: Harman Becker Automotive Systems GmbH, Karlsbad (DE)

(72) Inventor: Markus E. Christoph, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/668,924

(22) Filed: Oct. 30, 2019

(65) Prior Publication Data

US 2020/0066249 A1 Feb. 27, 2020

Related U.S. Application Data

(63) Continuation of application No. 15/861,339, filed on Jan. 3, 2018, now Pat. No. 10,497,357.

(30) Foreign Application Priority Data

Jan. 5, 2017 (EP) ..... 17150349

(51) Int. Cl.

| | |
|---|---|
| ***G10K 11/16*** | (2006.01) |
| ***G10K 11/178*** | (2006.01) |
| ***H04R 1/10*** | (2006.01) |

(52) U.S. Cl.

CPC ..... *G10K 11/17854* (2018.01); *H04R 1/1083* (2013.01); *G10K 2210/111* (2013.01);

(Continued)

(58) Field of Classification Search

CPC ... H04R 3/02; H04R 3/04; H04R 3/06; H04R 3/08; H04R 3/14; H04R 3/007;

(Continued)

(56) References Cited

U.S. PATENT DOCUMENTS 6,163,615 A * 12/2000 Callahan ..... H04R 1/1008 381/371

2009/0268931 A1 10/2009 Andrea et al.

(Continued)

FOREIGN PATENT DOCUMENTS

| | | | |
|---|---|---|---|
| EP | 3091750 | A1 | 11/2016 |
| WO | 2010048620 | A1 | 4/2010 |
| WO | 2016144509 | A1 | 9/2016 |

OTHER PUBLICATIONS

Jarrett et al., "On the Noise Reduction Performance of a Spherical Harmonic Domain Tradeoff Beamformer", IEEE Signal Processing Letters, vol. 19, No. 11, Nov. 2012, pp. 773-776.

(Continued)

*Primary Examiner* — Leshui Zhang

(74) *Attorney, Agent, or Firm* — Brooks Kushman P.C.

(57) ABSTRACT

An active noise reducing earphone includes a rigid cup-like shell having an inner surface and an outer surface is provided. The inner surface encompasses a cavity with an opening, and a microphone arrangement is configured to pick up sound with at least one steerable beam-like directivity characteristic, and to provide a first electrical signal that represents the picked-up sound. The earphone further includes an active noise control filter configured to provide, based on the first electrical signal, a second electrical signal, and a speaker disposed in the opening of the cavity and configured to generate sound from the second electrical signal. The active noise control filter has a transfer characteristic that is configured so that noise that travels through the shell from beyond the outer surface to beyond the inner surface is reduced by the sound generated by the speaker.

14 Claims, 7 Drawing Sheets

(52) U.S. Cl.
CPC ..... *G10K 2210/3028* (2013.01); *G10K 2210/3215* (2013.01); *H04R 2410/01* (2013.01); *H04R 2410/05* (2013.01); *H04R 2460/01* (2013.01)

(58) Field of Classification Search
CPC ..... H04R 5/04; H04R 25/453; H04R 25/50; H04R 25/505; H04R 25/507; H04R 1/1091; H04R 1/10; H04R 1/08; H04R 29/001; H04R 3/00; H04R 3/002; H04R 2420/07; H04R 2499/11; H04R 2217/03; H04R 2225/41; H04R 2225/43; H04R 1/1083; H04R 2410/01; H04R 2410/03; H04R 2410/05; H04R 2410/07; H04R 2460/01; H04R 2410/00; H03G 5/00; H03G 5/005; H03G 5/16; H03G 5/165; H03G 5/24; H03G 5/28; H03G 9/005; H03G 9/24; H03G 9/025; H03G 2201/702; H03G 7/007; G06F 3/165; G06F 17/3074; G10K 11/175; G10K 11/16; G10K 2210/3215; G10K 11/17881; G10K 11/17823; G10K 11/17854; G10K 11/17853; G10K 11/1785; G10K 11/178; G10K 2210/111; G10K 2210/3028; G10K 2210/3226; G10K 11/17861
USPC ..... 381/28, 59, 55, 317, 318, 321, 71.1, 381/71.11, 71.14, 74, 83, 332, 93, 96, 97, 381/98, 99, 100, 101, 102, 103, 106, 107, 381/108, 120, 121, 71.6; 327/551, 552, 327/553, 555, 560; 704/E21.007, E21.02; 379/406.01–406.16; 455/570; 700/94
See application file for complete search history.

(56) References Cited

U.S. PATENT DOCUMENTS

| | | | | |
|---|---|---|---|---|
| 2010/0158290 | A1 | 6/2010 | Puder | |
| 2013/0195296 | A1* | 8/2013 | Merks | H04R 25/402 381/313 |
| 2013/0208907 | A1* | 8/2013 | Isvan | H04R 1/083 381/71.6 |
| 2014/0294191 | A1* | 10/2014 | Parkins | A61F 11/14 381/72 |
| 2016/0171962 | A1* | 6/2016 | Jenkins | G10K 11/175 381/71.6 |
| 2016/0234610 | A1* | 8/2016 | Jensen | H04R 25/552 |
| 2016/0267898 | A1* | 9/2016 | Terlizzi | H04R 1/1091 |

OTHER PUBLICATIONS

Cohen, "Noise Reduction with Microphone Arrays for Speaker Identification", Jan. 27, 2012, 58 pages.
European Search Report for corresponding Application No. 19199174.4, filed Jan. 5, 2017, dated Jan. 20, 2020, 10 pgs.
Non-Final Office Action dated Mar. 29, 2019 for U.S. Appl. No. 15/861,339, filed Jan. 3, 2018, 21 pgs.

* cited by examiner

ACTIVE NOISE REDUCTION EARPHONES

CROSS-REFERENCE TO RELATED APPLICATIONS

This application is a continuation of U.S. application Ser. No. 15/861,339 filed Jan. 3, 2018, now U.S. Pat. No. 10,497,357, issued Dec. 3, 2019, which claims foreign priority benefits under 35 U.S.C. § 119(a)-(d) to EP Application Serial No. 17 150 349.3 filed Jan. 5, 2017, the disclosures of which are hereby incorporated in their entirety by reference herein.

TECHNICAL FIELD

The disclosure relates to earphones with active noise control (ANC) and a method for operating earphones with ANC.

BACKGROUND

Headphones may include active noise reduction, also known as active noise control (ANC). Generally, noise reduction may be classified as feedback noise reduction or feedforward noise reduction or a combination thereof. In a feedback noise reduction system, a microphone is positioned in an acoustic path that extends from a noise source to the ear of a user. A speaker is positioned between the microphone and the noise source. Noise from the noise source and anti-noise emitted from the speaker are collected by the microphone and, based on the residual noise thereof, the anti-noise is controlled to reduce the noise from the noise source. In a feedforward noise reduction system, a microphone is positioned between the noise source and the speaker. The noise is collected by the microphone, is inverted in phase and is emitted from the speaker to reduce the external noise. In a combined feedforward/feedback (hybrid) noise reduction system, a first microphone is positioned in the acoustic path between the speaker and the ear of the user. A second microphone is positioned in the acoustic path between the noise source and the speaker and collects the noise from the noise source. The output of the second microphone is used to make the transmission characteristic of the acoustic path from the first microphone to the speaker the same as the transmission characteristic of the acoustic path along which the noise from the noise source reaches the user's ear. The speaker is positioned between the first microphone and the noise source. The noise collected by the first microphone is inverted in phase and emitted from the speaker to reduce the external noise. It is desired to improve the known headphones in order to reduce the noise emitted by a multiplicity of noise sources from a multiplicity of directions.

SUMMARY

An active noise reducing earphone includes a rigid cup-like shell having an inner surface and an outer surface; the inner surface encompassing a cavity with an opening, and a microphone arrangement configured to pick up sound with at least one steerable beam-like directivity characteristic, and to provide a first electrical signal that represents the picked-up sound. The earphone further includes an active noise control filter configured to provide, based on the first electrical signal, a second electrical signal, and a speaker disposed in the opening of the cavity and configured to generate sound from the second electrical signal. The active noise control filter has a transfer characteristic that is configured so that noise that travels through the shell from beyond the outer surface to beyond the inner surface is reduced by the sound generated by the speaker.

An active noise reducing method for an earphone with a rigid cup-like shell, wherein the shell has an outer surface and an inner surface that encompasses a cavity with an opening, includes picking up sound with at least one steerable beam-like directivity characteristic, and providing a first electrical signal that represents the picked-up sound. The method further includes filtering the first electrical signal to provide a second electrical signal, and generating in the opening of the cavity sound from the second electrical signal. Filtering is performed with a transfer characteristic that is configured so that noise that travels through the shell from beyond the outer surface to beyond the inner surface is reduced by the sound generated in the opening.

Other systems, methods, features and advantages will be, or will become, apparent to one with skill in the art upon examination of the following detailed description and appended figures. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. In the figures, like referenced numerals designate corresponding parts throughout the different views.

DETAILED DESCRIPTION

Figure 1:
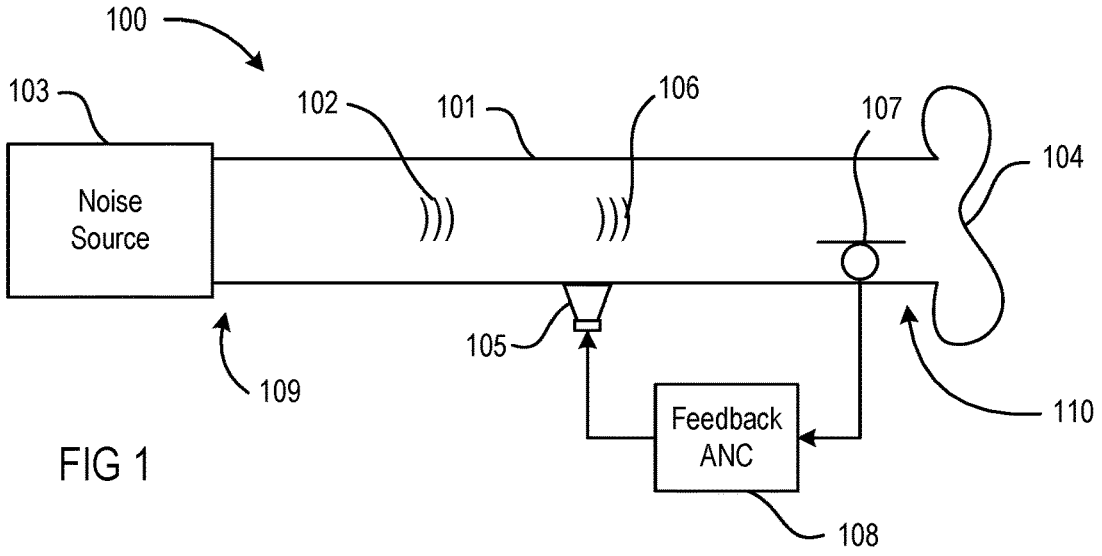
FIG. 1 is a simplified illustration of an exemplary feedback type active noise control (ANC) earphone.

FIG. 1 is a simplified illustration of an exemplary feedback type active noise control (ANC) earphone 100 (e.g., as part of a headphone with two earphones). An acoustic path (also referred to as channel), represented by a tube 101, is established by the ear canal, also known as external auditory meatus, and parts of the earphone 100, into which noise, i.e., primary noise 102, is introduced at a first end 109 from a noise source 103. The sound waves of the primary noise 102 travel through the tube 101 to the second end 110 of the tube 101 from where the sound waves are radiated, for example, to the tympanic membrane of an ear 104 of a user when the earphone 100 is attached to the user's head. In order to reduce or even cancel the primary noise 102 in the tube 101, a sound radiating transducer, for example, a speaker 105, introduces cancelling sound 106 into the tube 101. The cancelling sound 106 has an amplitude corresponding to or which is the same as the primary noise 102, however, of opposite phase. The primary noise 102 which enters the tube 101 is collected by an error microphone 107 and is processed by a feedback ANC processing module 108 to generate a cancelling signal and then emitted by the speaker 105 to reduce the primary noise 102. The error microphone 107 is arranged downstream of the speaker 105 and thus is closer to the second end 110 of the tube 101 than to the speaker 105, i.e., it is closer to the ear 104, in particular to its tympanic membrane.

Figure 2:
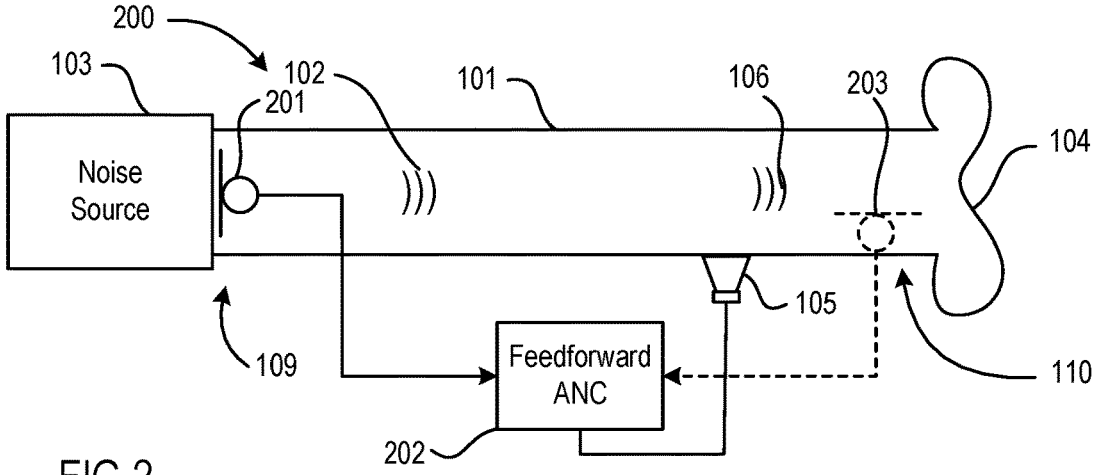
FIG. 2 is a simplified illustration of an exemplary feedforward type ANC earphone.

FIG. 2 is a simplified illustration of an exemplary feedforward type ANC earphone 200. The earphone 200 includes a microphone 201 that is arranged between the first end 109 of the tube 101 and the speaker 105, for example, as close as possible to the noise source 103. Furthermore, a feedforward ANC processing module 202 is connected between the microphone 201 and speaker 105. The feedforward ANC processing module 202 as shown may be, for example, a non-adaptive filter, i.e., a filter with fixed transfer function. Alternatively, the feedforward ANC processing module 202 may be adaptive (e.g., an adaptive filter) in connection with an additional error microphone 203 which is disposed between the speaker 105 and the second end 110 of the tube 101 (e.g., as close as possible to the ear 104) and which controls the transfer function of the feedforward ANC processing module 202. Further, a non-acoustic sensor (not shown) may be employed instead of the reference microphone 201.

Figure 3:
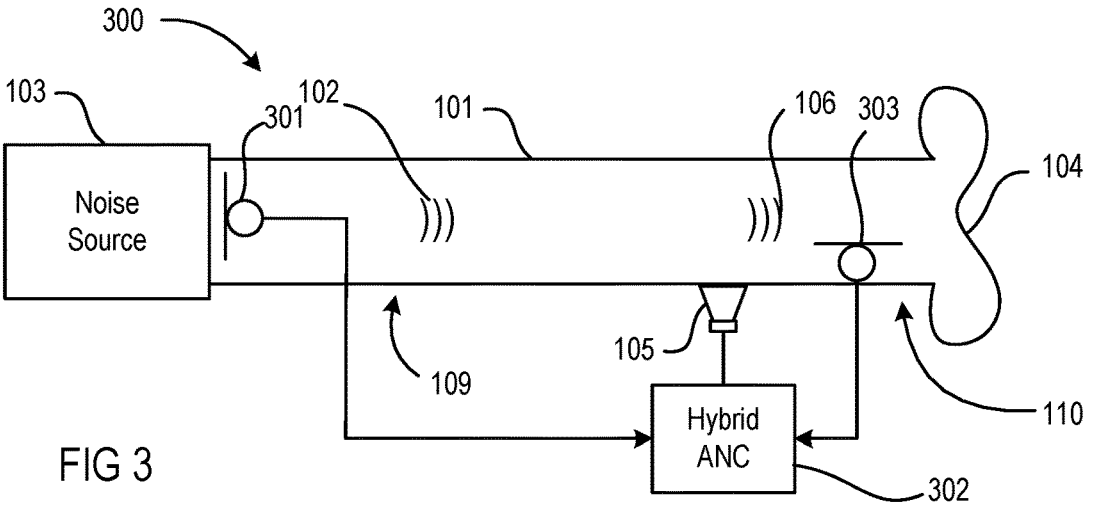
FIG. 3 is a simplified illustration of an exemplary hybrid type ANC earphone.

FIG. 3 is a simplified illustration of an exemplary hybrid type ANC earphone 300. A feedforward microphone 301 senses the primary noise 102 close to the noise source 103 and its output is supplied to a hybrid ANC processing module 302. The primary noise 102 and sound radiated from the speaker 105 are sensed close to the ear 104 by a feedback microphone 303 whose output is also supplied to the hybrid ANC processing module 302. The hybrid ANC processing module 302 generates a noise reducing signal which is emitted by the speaker 105 disposed between the two microphones 301 and 303, thereby reducing the undesirable noise at the ear 104.

Figure 4:
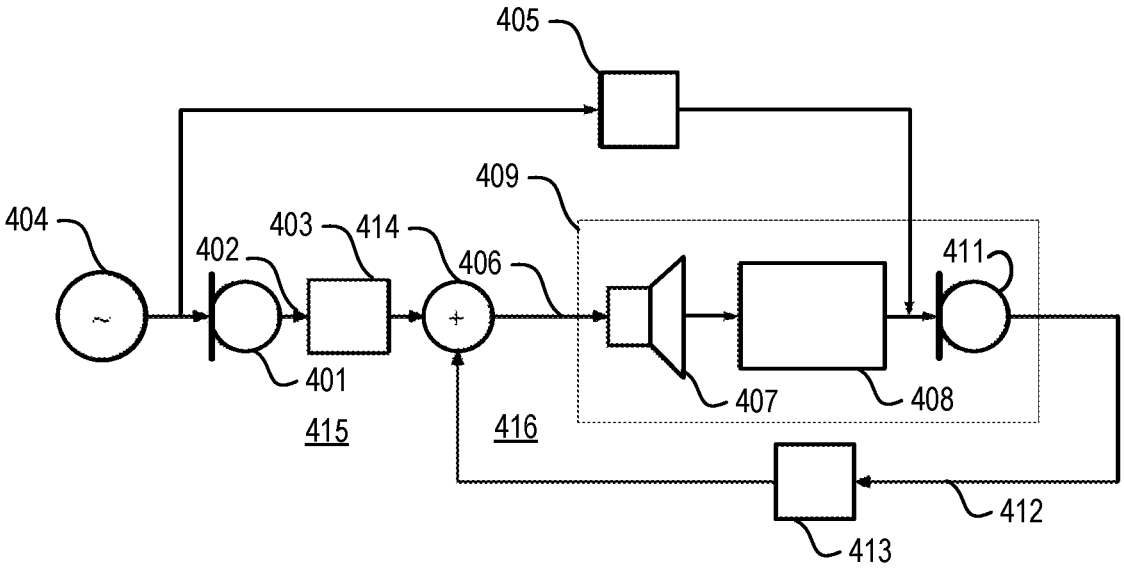
FIG. 4 is a block diagram of a hybrid type active noise reduction system in which a feedforward and feedback type active noise reduction system is combined.

Referring to FIG. 4, an exemplary hybrid noise reducing system (e.g., applicable in the hybrid type ANC earphone 300 shown in FIG. 3) includes a first microphone 401 that senses at a first location a noise signal from, for example, a noise source 404, and that is electrically coupled to a first microphone output path 402. A loudspeaker 407 is electrically coupled to a loudspeaker input path 406 and radiates noise reducing sound at a second location. A second microphone 411 that is electrically coupled to a second microphone output path 412 picks up residual noise at a third location, the residual noise being created by superimposing the noise received via a primary path 405 and the noise reducing sound received via a secondary path 408. A first (feedforward) active noise reducing filter 403 is connected between the first microphone output path 402 and via the adder 414 to the loudspeaker in-put path 406. A second (feedback) active noise reducing filter 413 is connected to the second microphone output path 412 and via an adder 414 to the loudspeaker input path 406. The second active noise reduction filter 413 is or comprises at least one shelving or equalization (peaking) filter. These filter(s) may have, for instance, a 2nd order filter structure. The active noise reducing filters 403 and 413 can be implemented in any analog or digital filter structure, for example, as digital finite impulse response filters.

In the system of FIG. 4, an open loop 415 and a closed loop 416 are combined, forming a so-called "hybrid" system. The open loop 415 includes the first microphone 401 and the first ANC filter 403. The closed loop 416 includes the second microphone 411 and the second ANC filter 413. First and second microphone output paths 402 and 412 and the loudspeaker input path 406 may include analog amplifiers, analog or digital filters, analog-to-digital converters, digital-to-analog converters or the like which are not shown for the sake of simplicity. The first ANC filter 403 may be or may comprise at least one shelving or equalization filter.

The shelving or equalizing filter of the first ANC filter may be an active or passive analog filter or a digital filter. The shelving filter in the second ANC filter may be an active or passive analog filter. For instance, the first ANC filter may be or may comprise at least one digital finite impulse response filter.

The system shown in FIG. 1 has a sensitivity which can be described by the equation:

$$N(z)=H(z)-WOL(z)\cdot SCL(z)/(1-WCL(z)\cdot SCL(z),$$

in which H(z) is the transfer characteristic of the primary path 405, WOL(z) is the transfer characteristic of the first ANC filter 403, SCL(z) is the transfer characteristic of the secondary path 408, and WCL(z) is the transfer characteristic of the second ANC filter 413. Advantageously, the first ANC filter 403 (closed loop) and the second ANC filter 413 (closed loop) can easily be optimized separately.

In theory, feedforward ANC system are very effective and easy to implement, since the optimal filter (WOL(z)), in contrast to feedback ANC system, can be directly calculated by the ratio of the primary path (H(z)) to the secondary path (SCL(z))→WOL(z)=H(z)/SCL(z)). While the secondary path in headphone applications more or less remains the same, this is, unfortunately not the case for the primary path. Depending on the noise source, the primary path will dynamically change, leading to a somewhat unpredictable ANC performance of feedforward systems. One way to overcome this backlog is, for example, to place the open loop (OL), which is the outside mounted microphone of the headphone, mechanically steerable and at a certain distance from the outer shell of each earphone.

Figure 5:
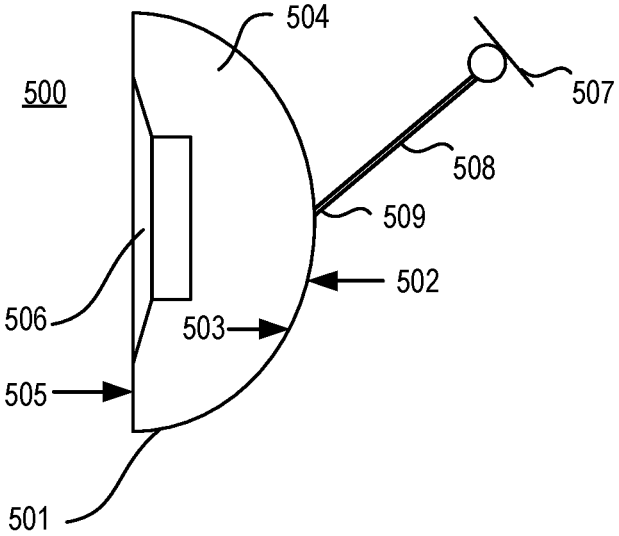
FIG. 5 is a simplified illustration of an exemplary earphone with a single small (reference) microphone mounted to the earphone via a rod and a joint.

In an exemplary earphone 500 (e.g., as part of a feedfoward ANC headphone with two earphones) shown in FIG. 5, a rigid cup-like shell 501 such as, for example, a hemisphere or the like, has an outer, for example, convex surface 502, and an inner, for example, concave surface 503 which encompasses a cavity 504 with an opening 505. An electroacoustic transducer for converting electrical signals into sound, such as a speaker 506, is disposed in the opening 505 of the cavity 504 and generates sound from an electrical signal provided by an active noise control filter (not shown). The active noise control (ANC) filter is commonly supplied with an electrical signal from a single (reference) microphone 507, which picks up sound at a position which is adjustable by way of a rod 508. The rod 508 mounts the microphone 507 to the convex surface 502 of the shell 501 at a joint 509. In order to allow the position of the microphone 507 to be adjustable, the rod 508 may be flexible (e.g., a gooseneck element) and/or the joint 509 may be articulated (e.g., a ball-and-socket joint).

The ANC filter may, for example, be configured to provide feedforward type or hybrid type active noise control. Whatever characteristics the microphone 507 may have, a share of the sound emitted by a noise source may be picked-up by microphone 507 while another share may not be. However, both shares may reach the ear of a user (not shown) wearing the headphones so that the sound picked-up by the microphone 507 and, thus, the electrical signal corresponding to the picked-up sound does not or does not fully represent the sound arriving at the user's ear. How much the microphone signal corresponds to the sound perceived by the user depends on the position and the directivity of the microphone 507. As a consequence, the noise reduction performance of the headphones is, inter alia, dependent on the position of the microphone 507 relative to the position of the noise source and the directivity of the microphone 507. As the position of the microphone 507 and, if it has a higher directivity, also the overall directivity characteristic are adjustable, a user wearing the headphones can, with appropriate adjustments, maximize the share of the sound picked-up by microphone 507. Thus, the arrangement including the microphone 507, the rod 508 and the joint 509 behaves like a kind of "mechanical" beamformer.

Figure 6:
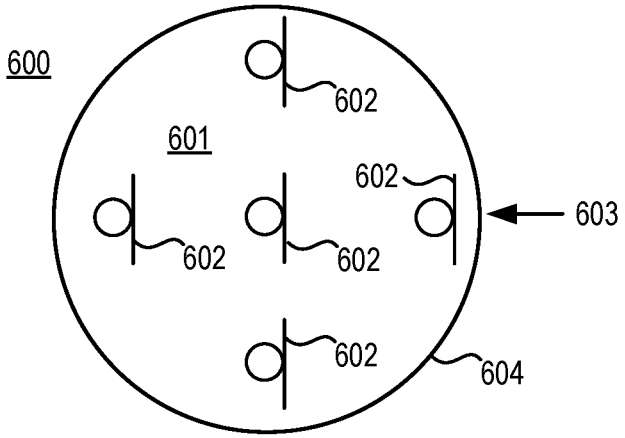
FIG. 6 is a simplified front view of an exemplary array of microphones regularly arranged over the shell of an earphone.
Figure 7:
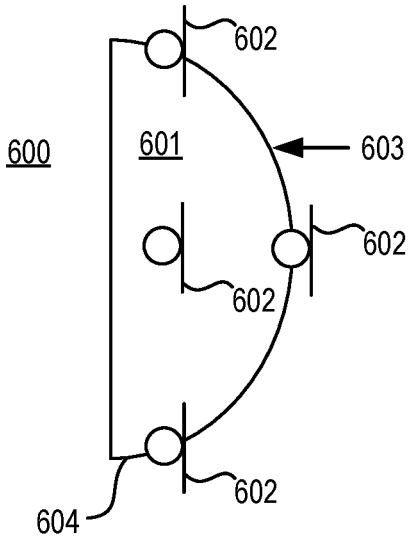
FIG. 7 is a simplified side view of the array shown in FIG. 6.

Instead of a single microphone with adjustable position and/or directivity characteristic, an earphone 600 with an array 601 of microphones 602 in connection with beamformer circuitry (not shown) may be employed, as shown in FIG. 6 which is a front view of the array of the microphones 602, a lateral view of which is shown in FIG. 7. As can be seen, the microphones are regularly distributed over a convex surface 603, which means that the microphones 602 may be formed, built, arranged, or ordered according to some established rule, law, principle, or type. In For example, the microphones 602 may be arranged both equilaterally and equiangularly as a regular polygon (two-dimensional arrangement) or may have faces that are congruent regular polygons, with all the polyhedral angles being congruent, as a regular polyhedron (three-dimensional arrangement). For example, three microphones 602 may be used which can be arranged at the corners of an equilateral triangle. Other arrangements may have four microphones disposed in the corners of a square. A multiplicity of arrangements of regularly distributed three or four microphones or more may be combined to form more complex arrangements. For example, FIGS. 6 and 7 show an arrangement of five microphones 602 regularly distributed over or in a convex surface 603 of, for example, a hemisphere (or semi-sphere) with one microphone in the surface center. "Regular" means that the microphones are disposed or arranged according to an established rule or principle such as being both equilaterally and equiangularly distributed with respect to each other. In contrast, "irregular" includes all other distributions such as random distributions.

Figure 8:
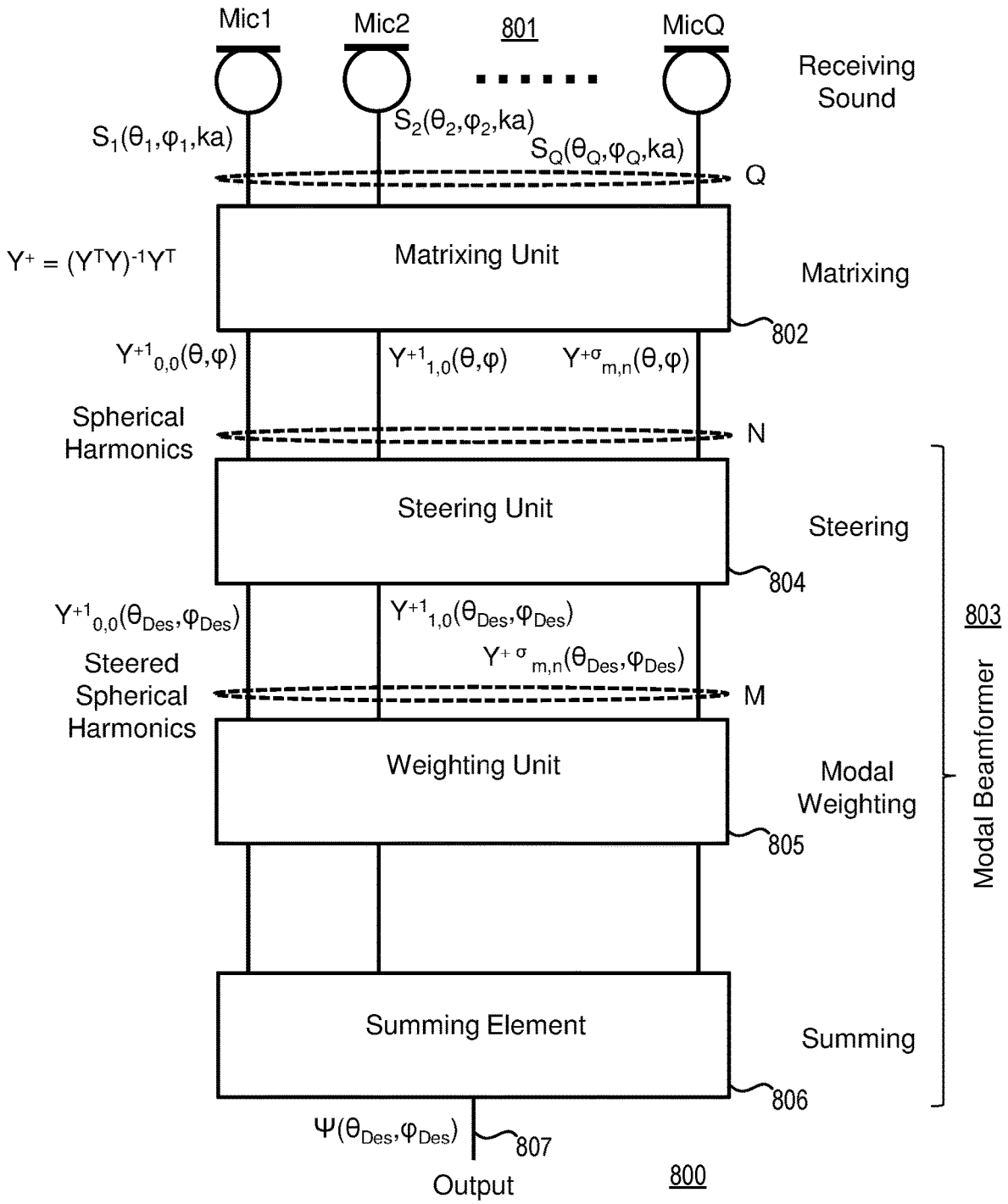
FIG. 8 is a signal flow chart illustrating an exemplary modal beamformer employing a weighting matrix for matrixing.
Figure 9:
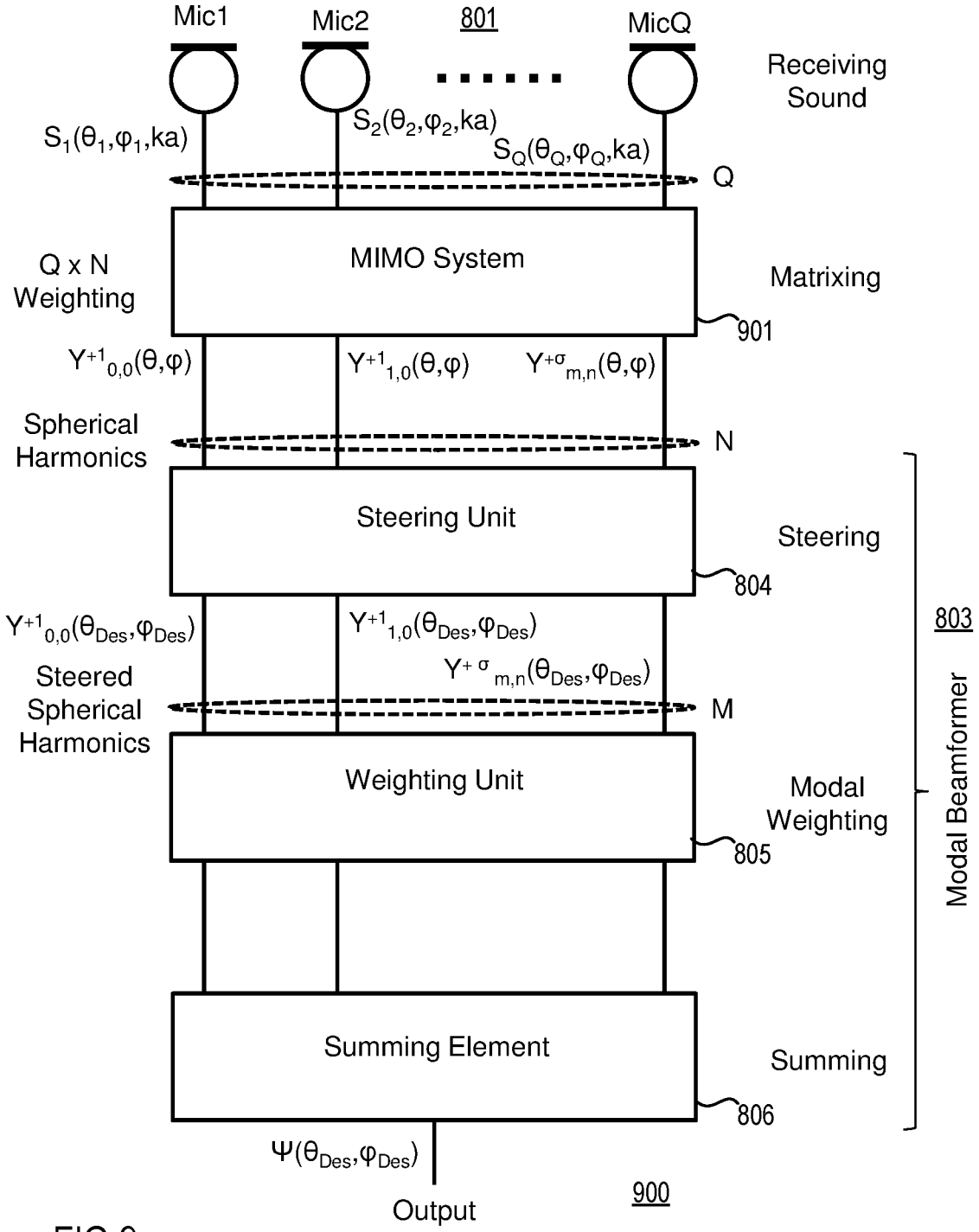
FIG. 9 is a signal flow chart illustrating an exemplary modal beamformer employing a multiple-input multiple-output block for matrixing.

Referring to FIGS. 8 and 9, beamformer circuitry applicable in connection with a microphone array 801 such as, for example, the microphone array 601 shown in FIGS. 6 and 7, may include a beamformer block 800 or 900, respectively. FIG. 8 is a signal flow chart illustrating the basic structure of beamformer block 800 which is connected to a plurality of Q microphones Mic1, Mic2, . . . MicQ that form microphone array 801, and includes a matrixing unit 802 (also known as modal decomposer or eigenbeam former), and a modal beamformer 803. The modal beamformer 803 comprises a steering unit 804, a weighting unit 805, and a summing element 806. Each microphone Mic1, Mic2, . . . MicQ generates a time-varying analog or digital audio signal $S_1(\theta_1,\varphi_1,ka)$, $S_2(\theta_1,\varphi_2,ka)$ . . . $S_Q(\theta_Q,\varphi_Q,ka)$ corresponding to the sound incident at the location of that microphone. The matrixing unit 801 decomposes (according to $Y^+=(Y^TY)^{-1}Y^T$) audio signals $S_1(\theta_1,\varphi_1,ka)$, $S_2(\theta_1,\varphi_2,ka)$ . . . $S_Q(\theta_Q,\varphi_Q,ka)$ generated by the array 805 to provide a set of spherical harmonics $Y^{+1}_{0,0}(\theta,\varphi)$, $Y^{+1}_{1,0}(\theta,\varphi)$, . . . $Y^{+\sigma}_{m,n}(\theta,\varphi)$, also known as eigenbeams or modal outputs, wherein each spherical harmonic $Y^{+1}_{0,0}(\theta,\varphi)$, $Y^{+1}_{1,0}(\theta,\varphi)$, . . . $Y^{+\sigma}_{m,n}(\theta,\varphi)$ corresponds to a different mode for the microphone array 801. The spherical harmonics $Y^{+1}_{0,0}(\theta,\varphi)$, $Y^{+1}_{1,0}(\theta,\varphi)$, . . . $Y^{+\sigma}_{m,n}(\theta,\varphi)$ are then processed by the modal beamformer 803 to provide an output signal 807 which is equal to $\Psi(\theta_{Des}, \varphi_{Des})$. Instead of a single beampattern, modal beamformer 803 may simultaneously generate two or more different beampatterns, each of which can be independently steered into (almost) any direction in space. Alternatively, weighting unit 805 may be arranged upstream of steering unit 804 and not downstream as shown so that the non-steered eigenbeams are weighted (not shown).

Figure 10:
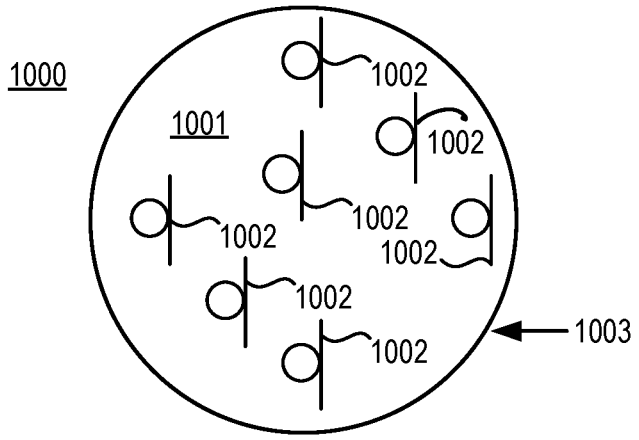
FIG. 10 is a simplified front view of an exemplary array of microphones irregularly arranged over the shell of an earphone.

As can be seen, it may be difficult to fulfill all given requirements in practice in order to utilize all theoretical concepts of modal beamformers, as it may be difficult to create headphones with hemispheric ear-cups, since they may have a bulky look which many may not consider to be a pleasing design. On the other hand it may also be sufficient to use microphones regularly spaced in a circle if a modal beamformer is only able to operate in one plane (two-dimensional). Unfortunately, this would be the vertical, and not, as desired, the horizontal plane, which makes this application possible, but, in fact, also questionable. A more practical approach to this drawback emerges if the modal beamforming concept is upgraded by a Multiple-Input-Multiple-Output (MIMO) system, as depicted below in FIG. 9. In this case it is possible to create a modal beamformer based on a body of arbitrary shape and on arbitrary positions of the microphones, as can be seen in FIG. 10.

In the alternative beamformer block 900 shown in FIG. 9, a multiple-input multiple-output system 901 is used instead of matrixing unit 802. FIG. 10 illustrates schematically an alternative earphone 1000 with an ear cup 1001 that has an arbitrary shape and a non-regular (irregular), three-dimensional distribution of a multiplicity of utilized microphones 1002.

Figure 11:
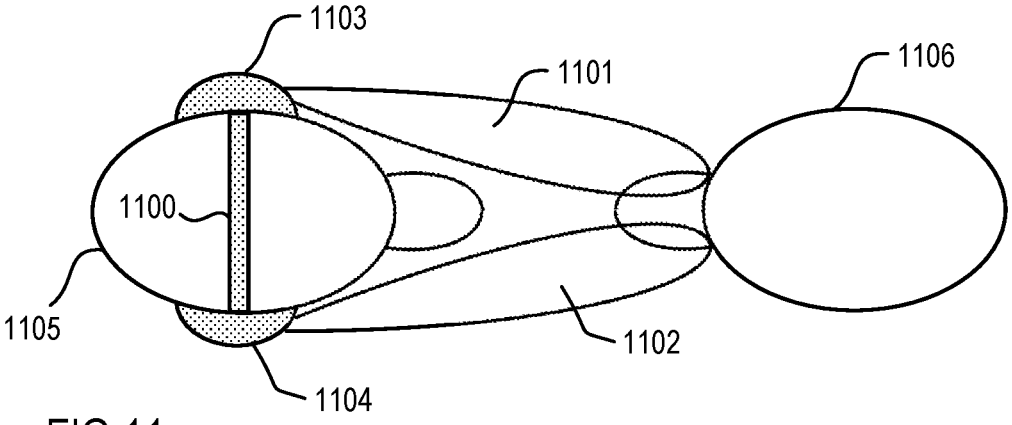
FIG. 11 is a simplified diagram illustrating a communication structure of a user wearing headphones with beamforming mode of operation.

Referring to FIG. 11, with the arrangements described above in connection with FIGS. 1-10, at least one beam (per earphone) can be formed, for example, two beams 1101 and 1102 originating from two earphones 1103 and 1104, and steered into any two-dimensional or three-dimensional direction where the primary noise source resides. All of this can be done with or even without a user 1103 adjusting the beam(s) 1101, 1102 to the direction of the noise source. Alternatively the beam(s) 1101, 1102 of the earphones 1003, 1004 may be steered to a desired target, for example, a person 1106 with whom the user 1105 wants to communicate, herein referred to as awareness function. The combination of ANC with microphone beamforming for picking up the reference signal can be applied not only to feedforward ANC headphones, but can also be beneficially integrated into hybrid ANC systems such as the hybrid ANC system shown in FIG. 4 or into any other non-ANC headphone to realize a so-called awareness mode of operation.

When the earphone is in an ANC mode of operation, automatically steering one or more beams into any two-dimensional or three-dimensional direction where the primary noise source resides, i.e., steering without a user 1103 adjusting the beam(s) 1101, 1102 into the direction of the noise source, the direction where the primary noise source resides may be estimated by calculating multiple beams that point in different directions, and selecting therefrom the beam with the worst signal-to-noise ratio (SNR), which is indicative of a noise source in this direction. Alternatively or additionally, a single beam may scan all directions repeatedly while the respective SNR for each direction is determined. Again, the direction of the beam with the worst SNR is indicative of a noise source in this direction. In a combination of the two options described above, multiple beams scan in different (preferred) directions and the beam with the worst SNR then scans around its preferred direction within a predetermined directional section, for example, between two neighboring fixed beams pointing in different neighboring directions of the currently as the best fixed beam appointed (e.g., between +20° and −20°) around this preferred direction to allow for a fine tuning of the beam.

When the earphone is in an awareness mode of operation, the ANC mode of operation may be deactivated and one or more beams are steered, as with the ANC mode of operation. However, not the beam with the worst SNR but the beam with the best SNR is selected. The beam with the best SNR represents the direction of a desired-sound source, for example, a speaker.

Figure 12:
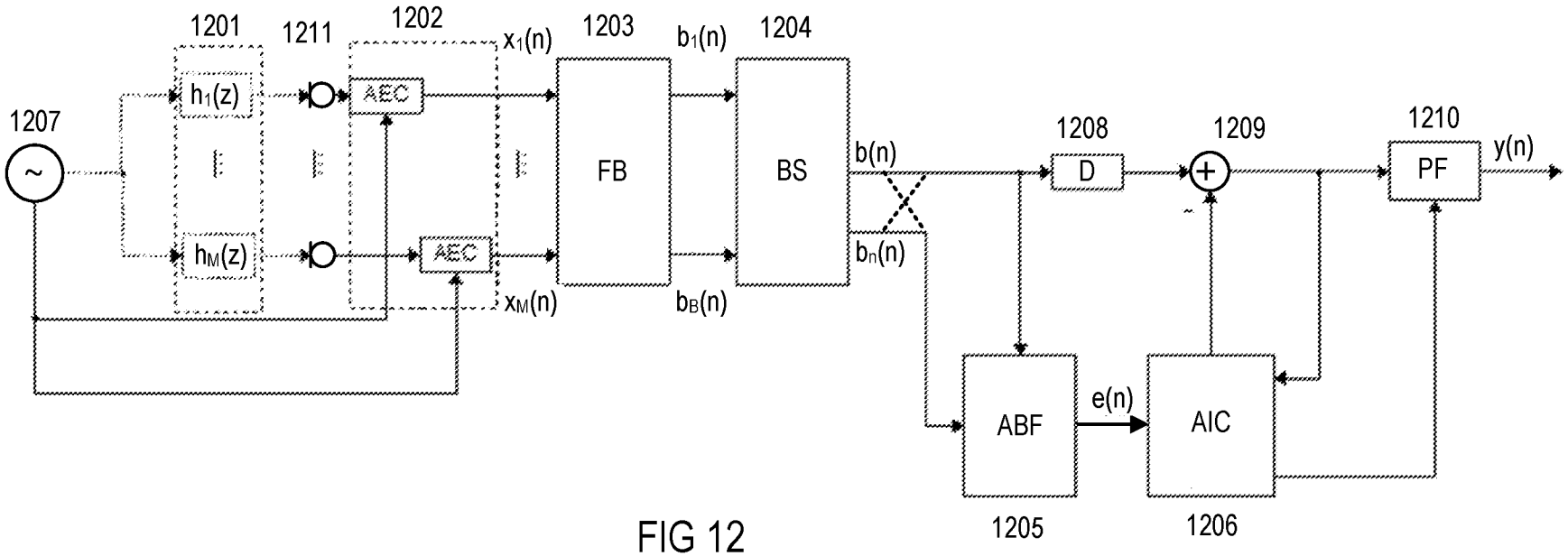
FIG. 12 is a schematic diagram illustrating an exemplary far field microphone system applicable in the communication structure shown in FIG. 11.

Referring to FIG. 12, in an exemplary far field microphone system applicable in the system shown in FIG. 11 in connection with the ANC mode of operation as well as the awareness mode of operation, sound from a desired sound source 1207 travels through a room, where it is filtered with the corresponding room impulse responses (RIRs) 1201 and may eventually be corrupted by noise, before the corresponding signals are picked up by M microphones 1211 of the far field microphone system. The far field microphone system shown in FIG. 12 further includes an acoustic echo cancellation (AEC) block 1202, a subsequent fixed beamformer (FB) block 1203, a subsequent beam steering block 1204, a subsequent adaptive blocking filter (ABF) block 1205, a subsequent adaptive interference canceller block 1206, and a subsequent adaptive post filter block 1210. As can be seen from FIG. 12, N source signals, filtered by the RIRs ($h_1, \ldots, h_M$), and eventually overlaid by noise, serve as an input to the AEC block 1202. The output signals of the fixed beamformer block 1203 serve as an input bi (n), wherein i=1, 2, . . . B, to the beam steering (BS) block 1204. Each signal from the fixed beamformer block 1203 is taken from a different room direction and may have a different SNR level.

The BS block 1204 delivers an output signal b(n) which represents the signal of the fixed beamformer block 1203 pointing into room direction with the best/highest current SNR value, referred to as positive beam, and a signal bn(n), representing the current signal of the fixed beamformer block 1203 with the least/lowest SNR value, referred to as negative beam. Based on these two signals b(n) and bn(n), the adaptive blocking filter (ABF) block 1205 calculates, dependent on the mode of operation, an output signal e(n) which ideally solely contains the current noise signal, but no useful signal parts or vice versa.

When an ANC mode of operation is active (indicated by doted lines at the output of BS block 1204 in FIG. 12), the ABF filter block 1205 may be configured to block, in an adaptive way, all signal parts other than useful signal parts still contained in the signal representing the positive beam b(n). The output signal e(n) of ABF filter block 1205 enters, together with the optionally, by a delay (D) line 1208 having a delay time γ, delayed signal representative of the negative beam $b_n(n-\gamma)$ the AIC block 1006 including, from a structural perspective, also a subtractor block 1209. Based on these two input signals e(n) and $b_n(n-\gamma)$, the AIC block 1206 including subtractor block 1209 generates an output signal which acts, on the one hand, as an input signal to a successive adaptive post filter (PF) block 1210 and, on the other hand, is fed back to the AIC block 1206, acting thereby as an error signal for the adaptation process which also employs AIC block 1206. The purpose of this adaptation process is to generate a signal which includes mainly noise signals and is ideally free of useful signals. In addition, the AIC block 1206 also generates time-varying filter coefficients for the adaptive PF block 1210 which is designed to remove further desired-signal components from the output signal of subtractor block 1209 and thus from the negative beam $b_n(n)$ to generate a total output signal y(n) which is the pure noise signal and may be used as an input signal of a feedforward ANC system or a feedforward block of hybrid system such as, for example, signal 402 in the hybrid ANC system depicted in FIG. 4.

Similarly, when the awareness mode of operation is active (indicated by solid lines at the output of BS block 1204 in FIG. 12), the "adaptive blocking filter" may be configured to block, in an adaptive way, signal parts other than noise signal parts still contained in the signal representing the negative beam $b_n(n)$. The output signal e(n) of ABF filter block 1205 enters, together with an optionally delayed signal representative of the positive beam b(n-γ) the AIC block 1206 including, from a structural perspective, subtractor block 1209. Based on these two input signals e(n) and b(n-γ), the AIC block 1206 generates an output signal which again, on the one hand, acts as an input signal to the successive adaptive post filter (PF) block 1210 and, on the other hand, is fed back to the AIC block 1206, acting thereby as an error signal for the adaptation process, which also employs AIC block 1206. The purpose of this adaptation process is to generate a signal which includes mainly desired signals, ideally free of noise. In addition, the AIC block 1206 also generates time-varying filter coefficients for the adaptive PF block 1210 which is designed to remove further noise components from the output signal of subtractor block 1209, and thus from the positive beam b(n), to generate the total output signal y(n) which is the pure desired signal and may be reproduced by way of the loudspeaker(s) of the earphone(s).

Optionally, in a basically awareness mode of operation, one or more adaptively steerable spatial roots may be generated to hide one or more noise sources. In a further option, awareness and ANC modes can be active simultaneously to address multiple noise and/or desired-signal sources. In a still further option, multiple beams may be steered to at least one individual noise and/or desired-signal source and the signals therefrom may be summed up or otherwise combined to create a sum noise or sum desired-signal of the multiple beams.

Parts or all of the beamformer circuitry may be implemented as software and firmware executed by a processor or a programmable digital circuit. It is recognized that any beamformer circuit as disclosed herein may include any number of microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof) and software which co-act with one another to perform operation(s) disclosed herein. In addition, any beamformer circuitry as disclosed may utilize any one or more microprocessors to execute a computer-program that is embodied in a non-transitory computer readable medium that is programmed to perform any number of the functions as disclosed. Further, any controller as provided herein may include a housing and a various number of microprocessors, integrated circuits, and memory devices, (e.g., FLASH, random access memory (RAM), read only memory (ROM), electrically programmable read only memory (EPROM), and/or electrically erasable programmable read only memory (EEPROM).

The description of embodiments has been presented for purposes of illustration and description. Suitable modifications and variations to the embodiments may be performed in light of the above description or may be acquired from practicing the methods. For example, unless otherwise noted, one or more of the described methods may be performed by a suitable device and/or combination of devices. The described methods and associated actions may also be performed in various orders in addition to the order described in this application, in parallel, and/or simultaneously. The described systems are exemplary in nature, and may include additional elements and/or omit elements.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects.

While various embodiments of the invention have been described, it will be apparent to those of ordinary skilled in the art that many more embodiments and implementations are possible within the scope of the invention. In particular, the skilled person will recognize the interchangeability of various features from different embodiments. Although these techniques and systems have been disclosed in the context of certain embodiments and examples, it will be understood that these techniques and systems may be extended beyond the specifically disclosed embodiments to other embodiments and/or uses and obvious modifications thereof.

What is claimed is:

1. An active noise reducing earphone comprising:

a rigid cup shell having an inner surface and an outer surface, the inner surface encompassing a cavity;

a microphone arrangement configured to pick up a sound with at least one steerable beam directivity characteristic, and to provide a first electrical signal that represents the picked-up sound;

an active noise control filter configured to provide, based on the first electrical signal, a second electrical signal; and a speaker disposed in the cavity and configured to generate a sound from the second electrical signal; where the active noise control filter has a transfer characteristic that is configured so that a noise that travels through the rigid cup shell from beyond the outer surface to beyond the inner surface is reduced by the sound generated by the speaker, wherein the microphone arrangement comprises:

an array of multiple microphones, the multiple microphones being distributed over the outer surface of the rigid cup shell;

a beamformer block electrically connected to the array of multiple microphones and configured to provide in connection with the array of multiple microphones, a directivity characteristic of the array of multiple microphones that includes at least one beam, and wherein:

the microphone arrangement is configured to provide an awareness mode of operation in which each of the at least one beams are steered in different directions and to evaluate a signal-to-noise ratio of each steered beam;

the direction in which one steered beam thereof having a highest signal-to-noise ratio is selected as the direction of a desired-sound source, and the active noise control filter is either activated or deactivated in the awareness mode while the one steered beam with the highest signal-to-noise ratio is selected as the direction of the desired-sound source.

2. The active noise reducing earphone of claim 1, wherein the microphone arrangement and the active noise control filter are part of a feedforward or hybrid active noise control structure.

3. The active noise reducing earphone of claim 1, wherein the active noise control filter is part of an adaptive control structure.

4. The active noise reducing earphone of claim 1, wherein the microphone arrangement comprises a single microphone adjustably mounted to the outer surface of the rigid cup shell via a rod member.

5. The active noise reducing earphone of claim 4, wherein the single microphone has a beam directivity characteristic.

6. The active noise reducing earphone of claim 1, wherein:

the multiple microphones of the array are regularly distributed over the outer surface of the rigid cup shell; and the beamformer block includes a modal beamformer and a matrixing block.

7. The active noise reducing earphone of claim 1, wherein:

the multiple microphones are irregularly distributed over the outer surface of the rigid cup shell; and the beamformer block includes a modal beamformer and a multiple-input multiple-output system.

8. The active noise reducing earphone of claim 1, wherein the beamformer block is configured to automatically adapt, in connection with the array of multiple microphones, at least one of the direction and directivity characteristic of the at least one beam.

9. An active noise reducing method for an earphone with a rigid cup shell having an inner surface and an outer surface; the inner surface encompassing a cavity\; the active noise reducing method comprising:

picking up a sound with at least one steerable beam directivity characteristic, and providing a first electrical signal that represents the picked-up sound;

filtering the first electrical signal to provide a second electrical signal; and generating in the cavity, a sound from the second electrical signal; where filtering is performed with a transfer characteristic that is configured so that a noise that travels through the rigid cup shell from beyond the outer surface to beyond the inner surface is reduced by the sound generated in the cavity, and beamforming based on multiple sound signals from an array of multiple microphones distributed over the outer surface of the rigid cup shell, wherein the beamforming is configured to provide a directivity characteristic of the array of multiple microphones that includes at least one beam, and wherein the array of multiple microphones is distributed over the outer surface of the rigid cup shell, wherein:

beamforming comprises an awareness mode of operation in which each of the at least one beams are steered in different directions and to evaluate a signal-to-noise ratio of each steered beam;

the direction in which the steered beam thereof having a highest signal-to-noise ratio is selected as the direction of a desired-sound source, and either activating or deactivating in the awareness mode, the filtering that is performed with the transfer characteristic while the steered beam with the highest signal-to-noise ratio is selected as the direction of the desired-sound source.

10. The active noise reducing method of claim 9, wherein the beamforming comprises an active noise cancellation mode of operation in which each of the at least one beams are steered in different directions and to evaluate a signal-to-noise ratio of each steered beam; and the direction in which the steered beam thereof having a worst signal-to-noise ratio is selected as a direction of a noise source.

11. An active noise reducing earphone comprising:

a rigid cup shell having an inner surface and an outer surface;

a microphone arrangement configured to pick up sound with at least one steerable beam directivity characteristic, and to provide a first electrical signal that represents the picked-up sound;

an active noise control filter configured to provide, based on the first electrical signal, a second electrical signal; and a speaker disposed in an opening of the inner surface and configured to generate a sound from the second electrical signal; where the active noise control filter has a transfer characteristic that is configured so that a noise that travels through the rigid cup shell from the outer surface to the inner surface is reduced by the sound generated by the speaker, wherein the microphone arrangement comprises:

an array of multiple microphones, the multiple microphones being distributed over the outer surface of the rigid cup shell;

a beamformer block electrically connected to the array of multiple microphones and configured to provide in connection with the array of multiple microphones, a directivity characteristic of the array of multiple microphones that includes at least one beam, and wherein:

the microphone arrangement is configured to provide an awareness mode of operation in which each of the at least one beams are steered in different directions and to evaluate a signal-to-noise ratio of each steered beam;

the direction in which the one steered beam thereof having a highest signal-to-noise ratio is selected as the direction of a desired-sound source, and the active noise control filter is either activated or deactivated in the awareness mode while the one steered beam with the highest signal-to-noise ratio is selected as the direction of the desired-sound source.

12. The active noise reducing earphone of claim 11, wherein:

the multiple microphones of the array are regularly distributed over the outer surface of the rigid cup shell; and the beamformer block includes a modal beamformer and a matrixing block.

13. The active noise reducing earphone of claim 11, wherein:

the multiple microphones are irregularly distributed over the outer surface of the rigid cup shell; and the beamformer block includes a modal beamformer and a multiple-input multiple-output system.

14. The active noise reducing earphone of claim 11, wherein:

the microphone arrangement is configured to provide an active noise cancellation mode of operation in which each of the at least one beams are steered in different directions and to evaluate a signal-to-noise ratio of each steered beam; and the direction in which the one steered beam having a worst signal-to-noise ratio is selected as a direction of a noise source.

* * * * *